US005205564A

United States Patent [19]

Lamberti et al.

[11] Patent Number: 5,205,564

[45] Date of Patent: Apr. 27, 1993

[54] BALL CATCHING NET APPARATUS

[76] Inventors: Catherine B. Lamberti, 1435 State St., #526, Santa Barbara, Calif. 93101; Nancy L. Honea, 2285 Whitney Ave., Summerland, Calif. 93067; Rodney D. Every, 171 Nectarine Ave. #1, Goleta, Calif. 93117

[21] Appl. No.: 873,725

[22] Filed: Apr. 27, 1992

[51] Int. Cl.[5] ..... A63B 69/00

[52] U.S. Cl. ..... 273/400; 273/26 A; 273/29 A; 273/181 F

[58] Field of Search ..... 273/400, 401, 26 A, 273/29 A, 181 F

[56] References Cited

U.S. PATENT DOCUMENTS

| | | | |
|---|---|---|---|
| 1,405,081 | 1/1922 | Whitney | 273/181 F |
| 1,540,670 | 6/1925 | Vidmer | 273/181 F |
| 3,408,071 | 10/1968 | Lundy | 273/26 A |
| 4,140,313 | 2/1979 | Martin | 273/29 A |

*Primary Examiner*—William H. Grieb
*Attorney, Agent, or Firm*—Jack C. Munro

[57] ABSTRACT

A ball catching net apparatus which has a back net from which extends, in a parallel relationship, sidewalls with a top wall interconnecting between the parallel sidewalls. The top wall, sidewalls and the back wall define a ball confining area. Within this ball confining area is located a pair of downwardly extending nets which are mounted on a mounting frame. Each of the downwardly extending nets can be used separately or together in order to achieve maximum absorption of the energy from the ball that is being directed into these nets. The mounting frame is to be pivotable between an extended position and a retracted position with the retracted position being located directly against the back net. Both of the downwardly extending nets are to be rolled up, each on a roller, into a storing position on the mounting frame. The mounting frame includes a forward extension which is separately pivotable relative to the remaining portion of the mounting frame and it is on this forward extension that one of the downwardly extending nets is mounted. The sidewalls of the ball catching net apparatus as well as the top wall can be folded into juxtaposition with the back net when the net apparatus is not being used.

9 Claims, 3 Drawing Sheets

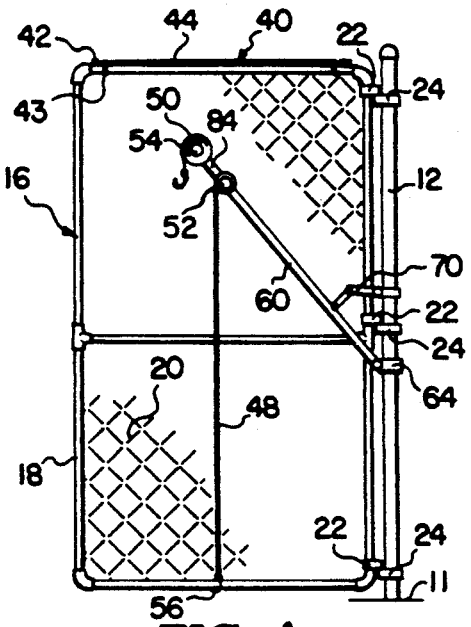
FIG. 4
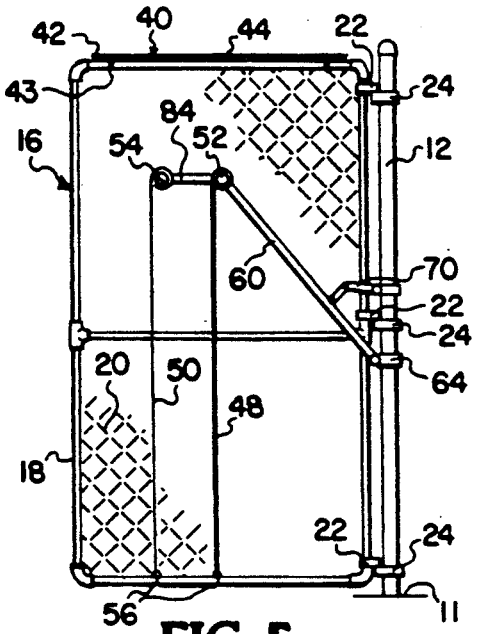
FIG. 5
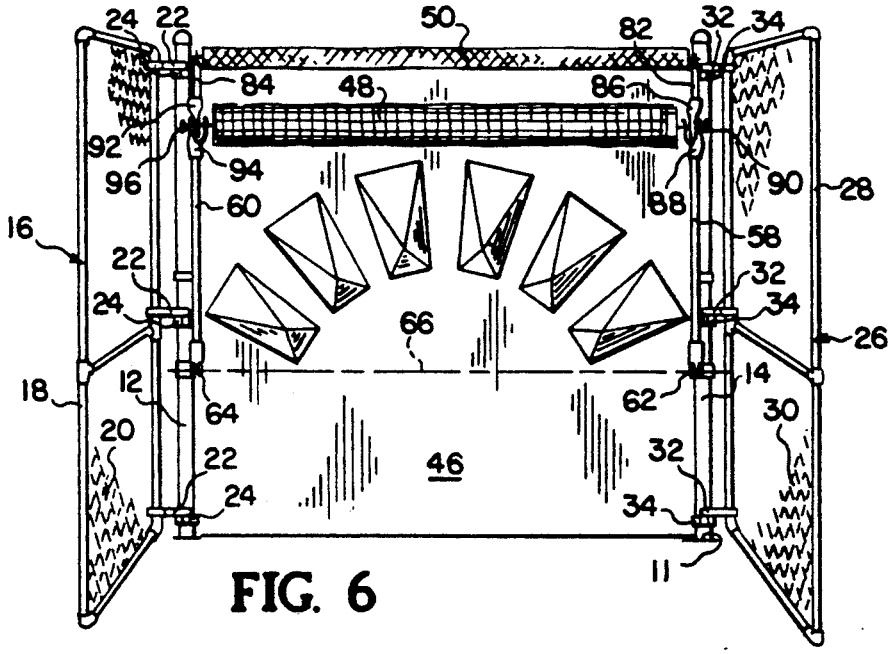
FIG. 6
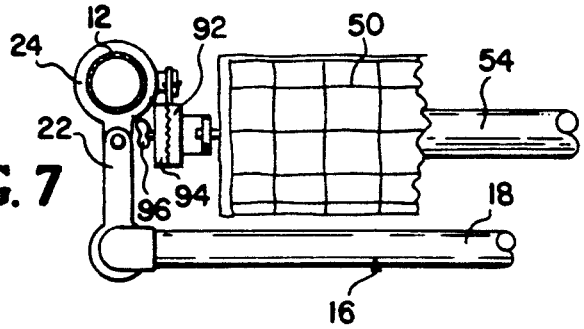
FIG. 7
FIG. 8
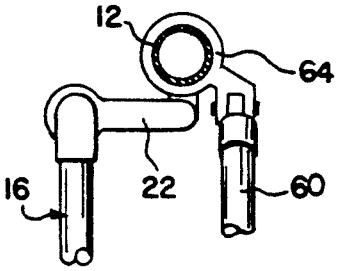

BALL CATCHING NET APPARATUS

BACKGROUND OF THE INVENTION

1) Field of the Invention

The field of this invention relates to sporting equipment and more particularly to a net apparatus which is to be usable to collect balls that are struck by a human when practicing of a particular sport.

2) Description of Prior Art

When practicing by humans of certain types of sports, the usage of a net to contain the trajectory of the ball has long been known. Examples of such nets are utilized when kicking a football, hitting of a baseball and striking of a golf ball. Generally, there is a single net constructed for baseball and another type of net for football, still another for golf.

Also in the past, such nets have been constructed as to be a permanent installation. Normally such nets have extended periods of times in which they are not being used. Therefore, the space that the net occupies is still being utilized even when the net is not being used.

SUMMARY OF THE INVENTION

The structure of the present invention provides for a ball catching net apparatus which utilizes an outer net arrangement which can be located to enclose a ball confining area. This ball catching net apparatus has an open front through which the ball is to be conducted and upon striking of either a sidewall, a top wall or a back wall, the ball will be confined within the ball catching area. The sidewalls and the top wall are capable of being moved directly adjacent the back net so as to place the ball catching net apparatus in a minimal space occupying position when such is not being used. When the ball catching net apparatus is being used there is also mounted within the ball confining area a separate pair of nets which are mounted on rollers with these rollers being mounted on a mounting frame. This mounting frame is to be pivotable between an extended position, located spaced from the back net, or to a retracted position which is located directly adjacent the back net. The retracted position is utilized when the ball catching net apparatus is being stowed and not being used. The forwardmost net of the pair of nets is separately pivotally mounted on the mounting frame so as to permit varying of its spacing from the remaining net of the pair of nets. The mounting frame is to be moveable between the extended position and the retracted position by means of a winch.

The primary objective of the present invention is to construct a ball catching net apparatus which ca be utilized with a wide number of ball type games facilitating practice of the game selected by a player or players;

Another objective of the present invention is to construct a ball catching net assembly that is moveable between a stowage position and a using position and when in the stowage position, a minimal usage of space occurs.

Another objective of the present invention is to construct a ball catching net apparatus which can be usable with a wide variety of different types of ball sports.

BRIEF DESCRIPTION OF THE DRAWINGS

FIG. 4 is a side elevational view similar to FIG. 2 but showing the internal net that is being utilized being located in a different position and also the internal net that is in the stowage position being shown in a slightly different position;

FIG. 5 is a view similar to FIG. 4 but showing both internal nets in a downwardly extending usable position;

FIG. 6 is a front view of the ball catching net apparatus showing the mounting frame which supports the internal nets being located in the stowage position;

FIG. 7 is a top plan view of a portion of the ball catching net apparatus of this invention showing the sidewall of the outer net arrangement being located in the stowage position which is in juxtaposition to the back net;

FIG. 8 is a view similar to FIG. 7 but showing the position of a sidewall when in the using position.

DETAILED DESCRIPTION OF THE SHOWN EMBODIMENT

Figure 1:
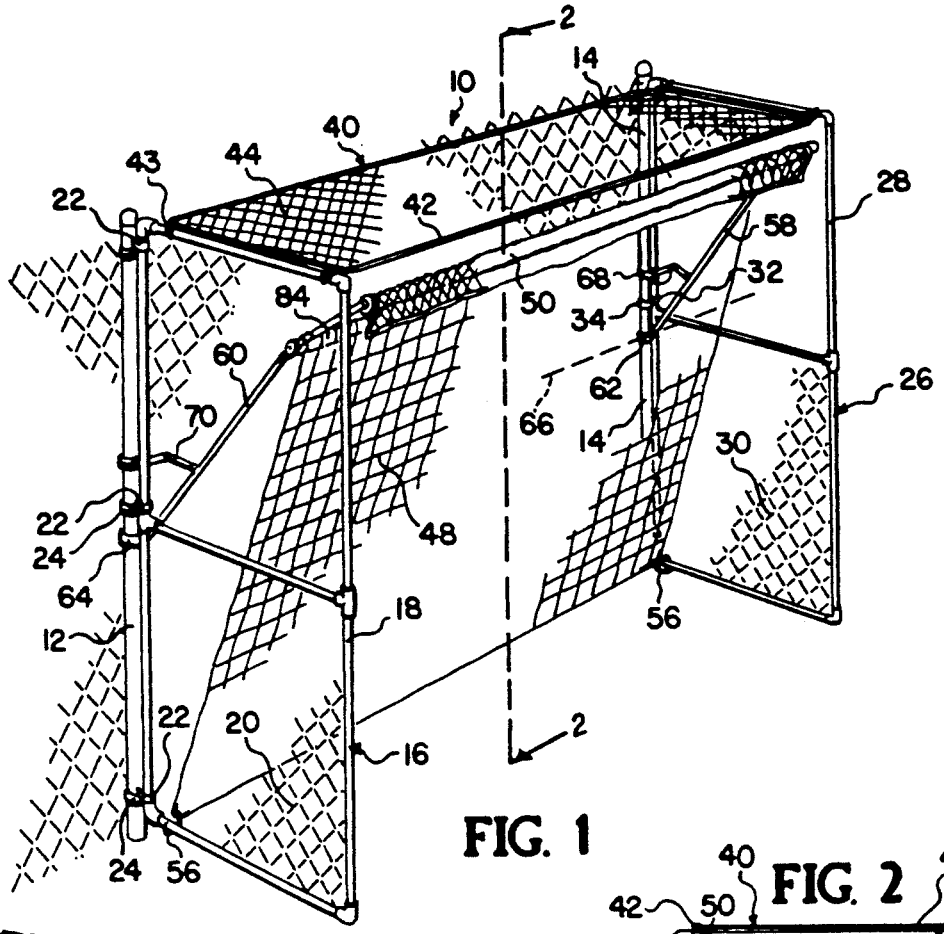
FIG. 1 shows the ball catching net apparatus of the present invention in the extended position ready to be used in conjunction with a ball sport with one of the internal nets being located in a ball catching position and the remaining internal net located in a stowage position.
Figure 2:
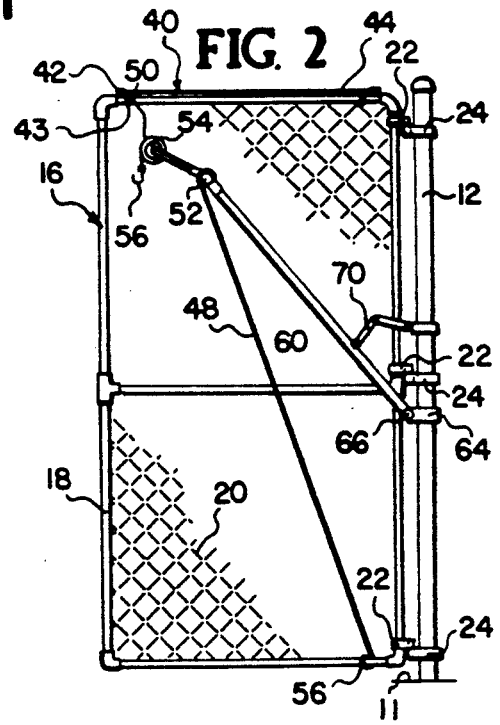
FIG. 2 is a side elevational view of the ball catching net apparatus of FIG. 1.
Figure 3:
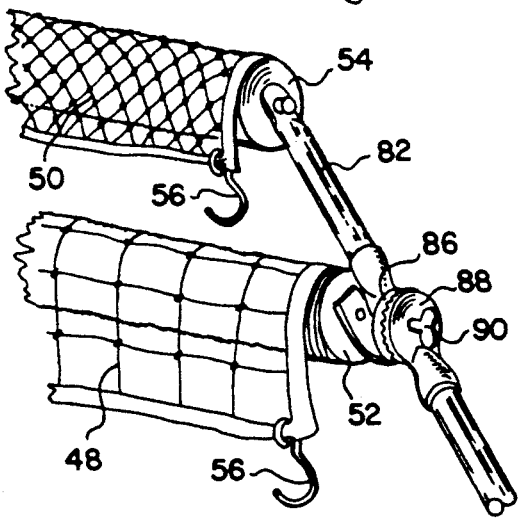
FIG. 3. is an isometric view of a portion of the mounting frame which supports the internal nets with these internal nets being located in the rolled-up (stowage) position.
Figure 9:
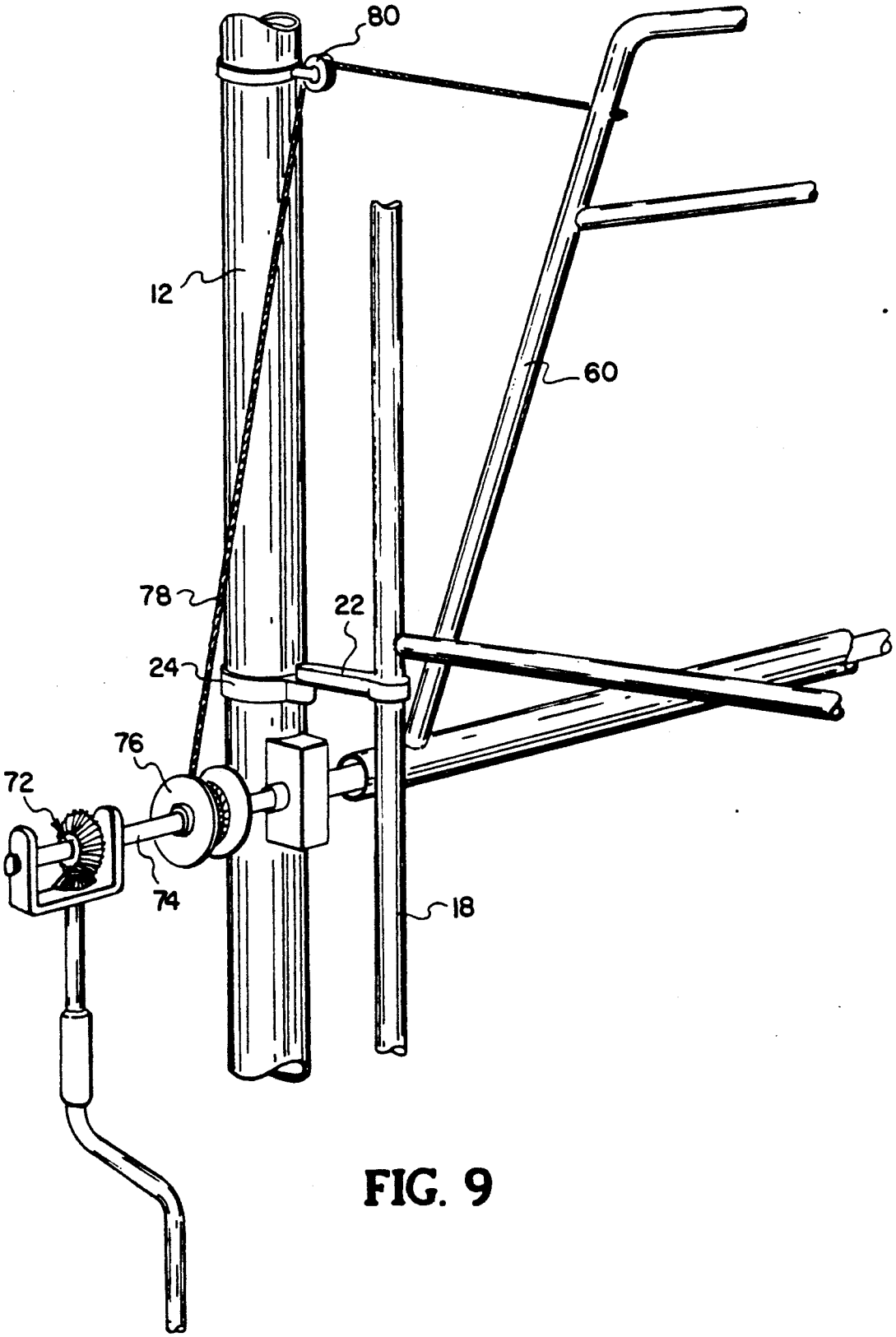
FIG. 9 is an enlarged isometric view of the invention showing the winch in more detail which is used to move the mounting frame from the extended position to the retracted position.

Referring particularly to the drawings there is shown a vertical section of the back net 10 which in this particular instance could be a chain-link type of fence. This fence 10 is mounted on a supporting surface 11 which could be dirt, grass, asphalt, cement or other similar type ground type surface. Mounted directly adjacent the back net 10 are a pair of spaced apart parallel vertical posts 12 and 14. These posts 12 and 14 ar to be penetratingly driven and fixed within the supporting surface 12. The spacing between the posts 12 and 14 is preselected with typical spacing being between in the range of six to ten feet.

Mounted on the post 12 is a sidewall 16. Sidewall 16 is constructed of a perimeter tubular frame 18 within which is supported a net (or chain-link) 20. The back edge of the frame 18 is fixedly secured to a plurality (such as three in number) of laterally extending arms 22. Each arm 22 is pivotally mounted on a ring 24 with it being understood that there is a separate ring 24 for each arm 22. Each of the rings 24 is fixedly mounted on the post 12.

The sidewall 16 is pivotally mounted on the post 12. The sidewall 16 can occupy a position substantially in juxtaposition with the back net 10 as shown in FIG. 7 or can occupy a position substantailly perpendicular to the back net 10 as shown in FIG. 8. The catching net apparatus of this invention is to have the sidewall 16 located in the position in FIG. 8 when the catching net apparatus is being used and, when the catching net apparatus is in the stowage position, the sidewall 16 is in the position shown in FIG. 7.

When the sidewall 16 is in the stowage position as shown in FIG. 7, it substantially covers about one half the length of the back net 10 between the posts 12 and 14. The remaining portion of the back net 10 between the posts 12 and 14 is to be covered by sidewall 26. Sidewall 26 is constructed essentially identical to sidewall 16 with it being composed of a perimeter frame 28 and a net (or chain-link) 30 mounted within the frame 28. This frame 28 has mounted thereon a plurality, spaced apart, laterally extending arms 32 which are pivotally mounted on rings 34. Arms 32 are essentially identical to arms 22 and are pivotally connected to the rings 34 which are fixedly mounted on the post 14.

When the sidewalls 16 and 26 are in the extended position, such are located parallel to each other as shown in FIGS. 1 and 6 of the drawings. With the sidewalls 16 and 26 in the retracted position, such are located in alignment and substantially parallel to the back net 10.

Pivotally mounted on the top of the sidewalls 16 and 28 is a top wall net 40. This top wall net 40 includes a perimeter binding 42 within which is supported a net 44. This top wall net 40 is secured on the sidewalls 16 and 26 by straps 43. The net 40 collapses when the sidewalls 16 and 26 are aligned in the stowage position. When the sidewalls 16 and 26 are located in their extended position as shown in FIGS. 1 and 6, the net 40 is stretched and defines the outer limits of the sidewalls 16 and 26 for the extended position. Net 40 will normally be constructed of a fabric.

When referring to FIG. 6 it can be seen that instead of the net 10 there can be utilized a return back wall 46 and then this return back wall 46 could be utilized to return the ball when playing of certain sports such as tennis and soccer.

With the sidewalls 16 and 26 located parallel to each other and the top wall 40 extending therebetween, there is enclosed a ball confining area. Within this ball confining area is located a first net 48 and a second net 50. Net 48 could be of a bigger weave than net 50 or vice versa. Net 48 could be utilized when playing with larger ball sports such as soccer, football and so forth. Smaller ball sports, such as golf, would be more inclined to use the net 50. The net 50 could be used without the use of net 48 or could be utilized in conjunction with the net 48.

The width of each of the nets 48 and 50 is essentially equal to the space in between the posts 12 and 14 though actually just a small amount less. Net 48 is mounted on a roller 52. Net 50 is being mounted on a roller 54. Net 48 is capable of being wound up to a stowage position on the roller 52 and similarly the net 50 can be wound up in a stowage position on the roller 54. The bottom or lower edge of each of the nets 48 and 50 include hooks 56. Each of the hooks 56 are capable of connecting with the lower edge of the perimeter frames 16 or 26 so as to secure in position the lower edge of its respective net 48 and 50 relative to the ball catching net apparatus.

The roller 52 is pivotally mounted between parallel spaced apart frame members 58 and 60 of a mounting frame. Frame member 58 is pivotally connected by a ring 62 to the post 14. In a similar manner the frame members 60 are pivotally connected to a ring 64 that is mounted on the post 12. Ring member 62 and 64 are located in an aligned position forming a horizontal pivot axis 66 therebetween. This pivot axis 66 can be oriented substantially at the middle of the height of the sidewalls 16 and 26 or can be located more closely to the ground 12 as is shown in FIG. 6.

Frame member 58 is connected to a movement limiting brace assembly 68. A similar movement limiting brace assembly 70 is connected to frame member 60. It is the function of the braces 68 and 70 to limit the outward pivoting movement of the respective arm members 58 and 60. It is to be understood that the arm members 58 and 60 will always move in unison.

Movement of the arm members 58 and 60 is accomplished by manual operation of a winch assembly 72. This winch assembly 72 is to be mounted exteriorly of the area defined between the posts 12 and 14. Winch assembly 72 rotates a rod 74. Mounted on the rod 74 are a pair of pulleys 76 with only one in number of the pulleys 76 being shown. There is to be utilized a pulley 76 directly adjacent the post 12 and likewise a pulley 76 directly adjacent the post 14. Connected to each pulley 76 is a wind-up cable 78 with it being understood that there are two in number of the wind-up cables 78. One of the wind-up cables 78 connects through an appropriate idler pulley 80 which is mounted on the post 12, with it being understood that there will be similar idler pulley 80 mounted on the post 14 for the remaining wind-up cable 78. One of the wind-up cables 78 connects to frame member 60 with the remaining similar cable 78 being connected to the frame member 58. Operation of the winch assembly 72 will cause the frame members 58 and 60 to pivot from the extended position shown in FIG. 1 to the retracted position shown in FIG. 6.

The roller 54 is mounted between a pair of forward extending arms 82 and 84. Arm 82 is fixedly attached to a plate 86. Plate 86 abuts against a plate 88. Plate 88 is fixedly mounted onto the frame member 58. Attaching plates 86 and 88 is a wing nut 90. In a similar manner the forward extending member 84 is fixed to a plate 92 which is to abut against a plate 94. Plate 94 is fixedly mounted on the frame member 60. Interconnecting the plates 92 and 94 is a wing nut 96.

The discs 88 and 90 as well as the discs 92 and 94 are to permit a limited amount of a pivoting movement of the arms 82 and 84 from the position shown in FIG. 4 to the position shown in FIG. 5. In FIG. 4, arm 82 is in alignment with the frame member 58 and arm 84 is in alignment with the frame member 60. In FIG. 5, the forward extending members 82 and 84 are located substantially parallel to the supporting surface 12 with the frame members 58 and 60 being in their outwardly extending position. As shown in FIG. 5, the net 50, when located vertical, is a small distance, such as four to five inches, spaced from the vertical position of the net 48. By loosening of wing nuts 90 and pivoting of the arms 82 and 84 relative to their respective frame members 58 and 60, this spacing between nets 48 and 50 can be varied, and with the forward extending members 82 and 84 in the position shown in FIG. 4, the minimum spacing arrangement is achieved. The maximum spacing arrangement is achieved in FIG. 5.

Nets 48 and 50 could be mounted other then by rolling upon rollers 52 and 54, respectively. For example, nets 48 and 50 could slide sideways on rollers 52 and 54 between the extended position and the stowage position similar to conventional "curtain rod" mountings.

What is claimed is:

1. A ball catching net apparatus comprising:

an outer net arrangement having parallel spaced-apart sidewalls which are connected by a top wall, said sidewalls having lower edges adapted to be located directly adjacent the supporting surface upon which said ball catching net apparatus is located, said outer net arrangement enclosing a ball confining area, said ball confining area having an open front and a closed back, said closed back having a back net, through said open front, there is to be conducted a ball at a trajectory that is to be contained by said ball catching net apparatus; and an internal net assembly mounted within said ball confining area, said internal net assembly comprising a first net and a second net located in juxtaposition, both said first net and said second net extending substantially the entire width and height of said ball confining area, both said first net and said second net being mounted on a mounting frame, said mounting frame being moveable within said ball confining area between a retracted position and an extended position, with said mounting frame in said retracted position, both said first net and said second net being located substantially against said back net, with said mounting frame in said extended position, both said first net and said second net being located spaced from said back net.

2. The ball catching net assembly as defined in claim 1 wherein:

said first net being substantially the same size as said second net.

3. The ball catching net apparatus as defined in claim 1 wherein:

both said first net and said second net being mounted on a separate roller with each said separate roller being rotationally mounted on said mounting frame, both said first net and said second net each being individually moveable from a rolled up position on its respective said roller to an extended position extending substantially adjacent to the supporting surface.

4. The ball catching net apparatus as defined in claim 1 wherein:

said second net being located closest to said open front, said second net being mounted on a forward extension of said mounting frame, said forward extension being separately pivotally moveable relative to the remaining portion of said mounting frame.

5. The ball catching net apparatus as defined in claim 1 wherein:

said mounting frame being pivotable about a horizontal axis.

6. The ball catching net apparatus as defined in claim 5 wherein:

said horizontal axis being located substantially at the mid-point of the height of said outer net arrangement.

7. The ball catching net apparatus as defined in claim 5 including:

winch means, said winch means being connected to said mounting frame, said winch means being manually operated to cause movement of said mounting frame between said retracted position and said extended position.

8. The ball catching net apparatus as defined in claim 4 wherein:

said forward extension being fixable in a selected position relative to the remaining portion of said mounting frame.

9. The ball catching net apparatus as defined in claim 1 wherein:

said sidewalls being pivotable relative to said back net, each said sidewall to be positionable to be in substantial alignment with each other and in juxtaposition with said back net.

* * * * *